US009377225B2

(12) United States Patent
Song et al.

(10) Patent No.: US 9,377,225 B2
(45) Date of Patent: Jun. 28, 2016

(54) OUTDOOR HEAT EXCHANGER AND AIR CONDITIONER COMPRISING THE SAME

(71) Applicant: LG Electronics Inc., Seoul (KR)

(72) Inventors: Chiwoo Song, Seoul (KR); Yongcheol Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 278 days.

(21) Appl. No.: 13/756,913

(22) Filed: Feb. 1, 2013

(65) Prior Publication Data

US 2013/0219943 A1 Aug. 29, 2013

(30) Foreign Application Priority Data

Feb. 3, 2012 (KR) ..... 10-2012-0011308

(51) Int. Cl.

| | |
|---|---|
| ***F25B 39/00*** | (2006.01) |
| ***F24F 1/14*** | (2011.01) |
| ***F28F 27/02*** | (2006.01) |
| ***F25B 30/02*** | (2006.01) |
| ***F25B 13/00*** | (2006.01) |
| ***F25B 47/02*** | (2006.01) |
| *F28D 21/00* | (2006.01) |

(52) U.S. Cl.

CPC . *F25B 39/00* (2013.01); *F24F 1/14* (2013.01); *F25B 13/00* (2013.01); *F25B 30/02* (2013.01); *F25B 47/022* (2013.01); *F28F 27/02* (2013.01); *F25B 2313/0251* (2013.01); *F25B 2400/13* (2013.01); *F28D 2021/0068* (2013.01); *F28F 2250/06* (2013.01)

(58) Field of Classification Search

CPC ..... F24F 1/14; F25B 30/02; F25B 39/00; F25B 47/022; F25B 47/025; F25B 13/00; F28F 27/02

See application file for complete search history.

(56) References Cited

U.S. PATENT DOCUMENTS 3,142,970 A * 8/1964 Hale ..... 62/324.1
4,774,813 A * 10/1988 Yokoyama ..... 62/81

(Continued)

FOREIGN PATENT DOCUMENTS

JP 2003-121019 * 4/2003 ..... F25B 13/00

*Primary Examiner* — Mohammad M Ali
*Assistant Examiner* — Christopher R Zerphey
(74) *Attorney, Agent, or Firm* — Dentons US LLP

(57) ABSTRACT

The present invention relates to an outdoor heat exchanger and air conditioner in which the passage of a refrigerant is varied in an air cooling operation and an air heating operation. An outdoor heat exchanger according to an embodiment of the present invention includes a first header pipe configured to have a refrigerant, compressed by a compressor, to flow therein in the air cooling operation, a first heat exchange unit coupled to the first header pipe and configured to thermally exchange the refrigerant with air, a bypass pipe configured to have the refrigerant, thermally exchanged in the first heat exchange unit, to flow therein in the air cooling operation, a first distribution pipe coupled to the bypass pipe, a second header pipe configured to have the refrigerant, passing through the bypass pipe, to flow therein in the air cooling operation, a second heat exchange unit coupled to the second header pipe and configured to thermally exchange the refrigerant with air, a second distribution pipe configured to have the refrigerant, thermally exchanged in the second heat exchange unit, to flow therein in the air cooling operation, a second hot gas pipe configured to couple the compressor and the second distribution pipe, and a second hot gas control valve disposed in the second hot gas pipe to control a flow of the refrigerant.

11 Claims, 4 Drawing Sheets

(56) References Cited

U.S. PATENT DOCUMENTS 4,901,534 A * 2/1990 Nakatsuno et al. ..... 62/81
2004/0134205 A1* 7/2004 Park et al. ..... 62/151
2010/0170270 A1* 7/2010 Jang et al. ..... 62/81

* cited by examiner

OUTDOOR HEAT EXCHANGER AND AIR CONDITIONER COMPRISING THE SAME

CROSS-REFERENCE TO RELATED APPLICATION

This application claims the benefit of Korean Application No. 10-2012-0011308, filed on Feb. 3, 2012 in the Korean Intellectual Property Office, the disclosure of which is incorporated herein by reference.

BACKGROUND OF THE INVENTION

1. Field of the Disclosure

The present invention relates to an outdoor heat exchanger and, more particularly, to an outdoor heat exchanger in which the passage of a refrigerant is varied in an air cooling operation and an air heating operation.

2. Discussion of the Related Art

In general, an air conditioner is an apparatus configured to include a compressor, an outdoor heat exchanger, an expansion valve, and an indoor heat exchanger and to cool or heat the interior of a room using a refrigerating cycle. That is, the air conditioner may include a cooler for cooling the interior of a room and a heater for heating the interior of a room. The air conditioner may also be formed of a combination cooling and heating air conditioner for cooling or heating the interior of a room.

If the air conditioner is formed of the combination cooling and heating air conditioner, the air conditioner further includes a 4-way valve for changing the passage of a refrigerant, compressed by the compressor, depending on an air cooling operation or an air heating operation. That is, in the air cooling operation, the refrigerant compressed by the compressor flows in the outdoor heat exchanger through the 4-way valve, and the outdoor heat exchanger functions as a condenser. Next, the refrigerant condensed by the outdoor heat exchanger is expanded by the expansion valve, and the condensed refrigerant flow in the indoor heat exchanger. In this case, the indoor heat exchanger functions as an evaporator. Next, the refrigerant evaporated by the indoor heat exchanger flows in the compressor through the 4-way valve.

Meanwhile, in the air heating operation, the refrigerant compressed by the compressor flows in the indoor heat exchanger through the 4-way valve, and the indoor heat exchanger functions as a condenser. Next, the refrigerant condensed by the indoor heat exchanger is expanded by the expansion valve, and the expanded refrigerant flows in the outdoor heat exchanger. In this case, the outdoor heat exchanger functions as an evaporator. Next, the refrigerant evaporated by the outdoor heat exchanger flows in the compressor through the 4-way valve.

SUMMARY

An object of the present invention is to provide an outdoor heat exchanger in which the passage of a refrigerant is varied in an air cooling operation and an air heating operation.

Another object of the present invention is to provide an outdoor heat exchanger which efficiently performs a defrosting operation of removing frost generated in the outdoor heat exchanger.

Objects of the present invention are not limited to the above-mentioned objects, and other objects that have not been described above will be evident to those skilled in the art from the following description An outdoor heat exchanger according to an embodiment of the present invention includes a first header pipe configured to have a refrigerant, compressed by a compressor, to flow therein in the air cooling operation, a first heat exchange unit coupled to the first header pipe and configured to thermally exchange the refrigerant with air, a bypass pipe configured to have the refrigerant, thermally exchanged in the first heat exchange unit, to flow therein in the air cooling operation, a first distribution pipe coupled to the bypass pipe, a second header pipe configured to have the refrigerant, passing through the bypass pipe, to flow therein in the air cooling operation, a second heat exchange unit coupled to the second header pipe and configured to thermally exchange the refrigerant with air, a second distribution pipe configured to have the refrigerant, thermally exchanged in the second heat exchange unit, to flow therein in the air cooling operation, a second hot gas pipe configured to couple the compressor and the second distribution pipe, and a second hot gas control valve disposed in the second hot gas pipe to control a flow of the refrigerant.

The first header pipe may be coupled to the second header pipe, and the outdoor heat exchanger possibly further comprises a check valve disposed in the first header pipe and configured to prevent the refrigerant from flowing from the first header pipe to the second header pipe in the air cooling operation.

The second heat exchange unit may be disposed beneath the first heat exchange unit.

The outdoor heat exchanger possibly further comprises a bypass valve disposed in the bypass pipe and opened or closed in order to control the flow of the refrigerant, wherein the bypass valve may be opened in the air cooling operation. In a partial defrosting operation, the second hot gas control valve may be opened, the bypass valve may be closed, and the refrigerant compressed by the compressor may flow in the second heat exchange unit.

The outdoor heat exchanger possibly further comprises, a first expansion valve disposed in the first distribution pipe and configured to control a degree of opening, and a second expansion valve disposed in the second distribution pipe and configured to control a degree of opening. The first expansion valve may be closed in the air cooling operation and the second expansion valve may be opened in the air cooling operation.

An air conditioner according to another embodiment of the present invention includes, a compressor; an indoor heat exchanger; an outdoor heat exchanger; and a 4-way valve guiding the refrigerant compressed by the compressor to the outdoor heat exchanger in an air cooling operation and in a defrosting operation, and guiding the compressed refrigerant to the indoor heat exchanger in an air heating operation, wherein an outdoor heat exchanger comprises, a first header pipe coupled to the compressor, a first heat exchange unit configured to have one end coupled to the first header pipe and to thermally exchange a refrigerant with air, a first distribution pipe coupled to the other end of the first heat exchange unit, a bypass pipe coupled to the first distribution pipe, a second header pipe coupled to the first header pipe and the bypass pipe, a second heat exchange unit configured to have one end coupled to the second header pipe and to thermally exchange the refrigerant with air, a second distribution pipe coupled to the other end of the second heat exchange unit, a second hot gas pipe configured to couple the compressor and the second distribution pipe, and a second hot gas control valve disposed in the second hot gas pipe and opened or closed in order to control a flow of the refrigerant.

The outdoor heat exchanger possibly further comprises a bypass valve disposed in the bypass pipe to control the flow of the refrigerant. The bypass valve may be opened in the air cooling operation. In the defrosting operation, the second hot gas control valve may be opened, the bypass valve may be closed, and the refrigerant compressed by the compressor may flow in the second heat exchange unit.

Details of other embodiments are included in the detailed description and drawings.

BRIEF DESCRIPTION OF THE DRAWINGS

The above and other objects and features of the present invention will become apparent from the following description of some embodiments given in conjunction with the accompanying drawings, in which.

DETAILED DESCRIPTION OF THE EMBODIMENTS

Merits and characteristics of the present invention and methods for achieving them will become more apparent from the following embodiments taken in conjunction with the accompanying drawings. However, the present invention is not limited to the disclosed embodiments, but may be implemented in various ways. The embodiments are provided to complete the disclosure of the present invention and to allow those having ordinary skill in the art to fully understand the scope of the present invention. The present invention is defined by the category of the claims. The same reference numbers will be used throughout the drawings to refer to the same or like parts.

Hereinafter, embodiments of the present invention will be described in detail with reference to the accompanying drawings for describing an outdoor heat exchanger.

Figure 1:
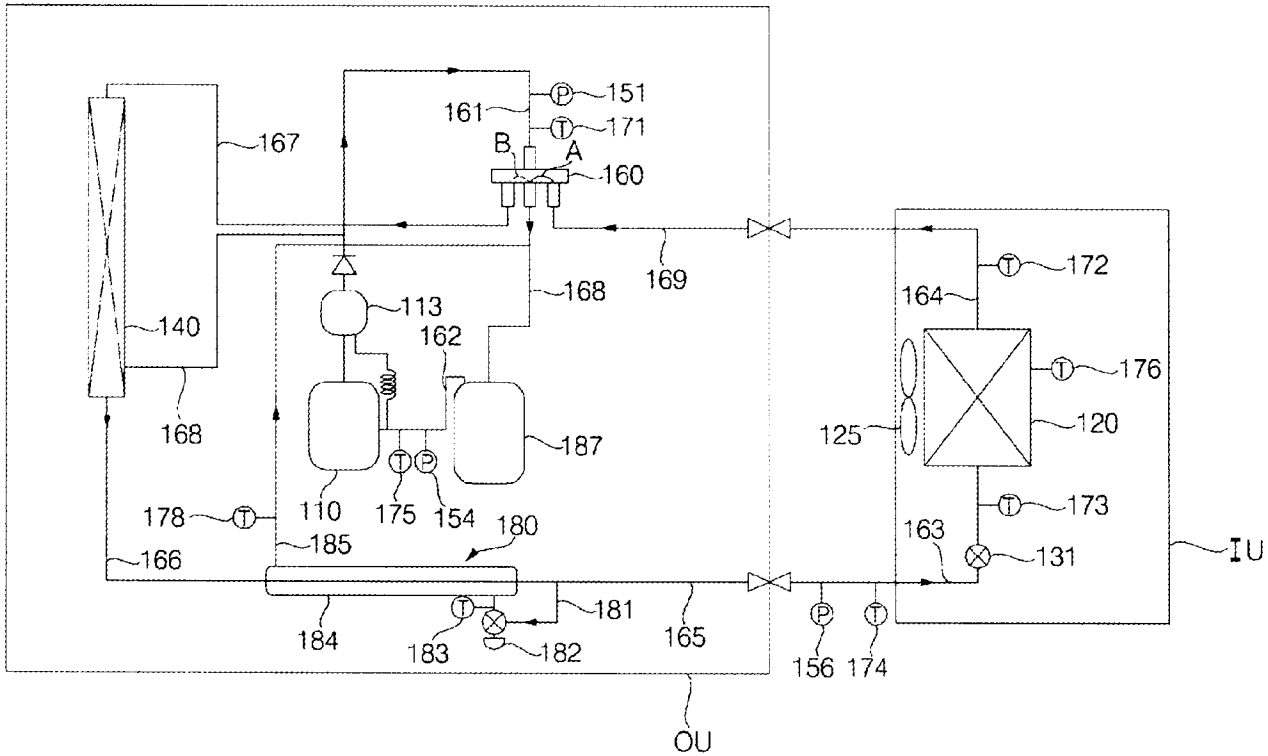
FIG. 1 shows the construction of an air conditioner according to an embodiment of the present invention.

FIG. 1 shows the construction of an air conditioner according to an embodiment of the present invention.

The air conditioner according to the embodiment of the present invention includes an outdoor unit OU and an indoor unit IU.

The outdoor unit OU includes a compressor 110, an outdoor heat exchanger 140, and a supercooler 180. The air conditioner may include one or a plurality of the outdoor units OU.

The compressor 110 compresses a refrigerant of a low temperature and low pressure into a refrigerant of a high temperature and high pressure. The compressor 110 may have various structures, and an inverter type compressor or a constant speed compressor may be adopted as the compressor 110. A discharge temperature sensor 171 and a discharge pressure sensor 151 are installed on the discharge pipe 161 of the compressor 110. Furthermore, a suction temperature sensor 175 and a suction pressure sensor 154 are installed on the suction pipe 162 of the compressor 110.

The outdoor unit OU is illustrated as including one compressor 110, but the present invention is not limited thereto. The outdoor unit OU may include a plurality of the compressors and may include both an inverter type compressor and a constant speed compressor.

An accumulator 187 may be installed in the suction pipe 162 of the compressor 110 in order to prevent a refrigerant of a liquid state from entering the compressor 110. An oil separator 113 for collecting oil from the refrigerant discharged from the compressor 110 may be installed in the discharge pipe 161 of the compressor 110.

The discharge pipe 161 from which the refrigerant compressed by the compressor 110 is discharged is branched into a hot gas pipe 168. The hot gas pipe 168 couples the compressor 110 and the outdoor heat exchanger 140, so that the refrigerant compressed by the compressor 110 flows in the outdoor heat exchanger 140. The hot gas pipe 168 is used in a defrosting operation to be described later.

A 4-way valve 160 is a passage switch valve for switching cooling and heating. The 4-way valve 160 guides the refrigerant compressed by the compressor 110 to the outdoor heat exchanger 140 in an air cooling operation and guides the compressed refrigerant to an indoor heat exchanger 120 in an air heating operation. The 4-way valve 160 is in an A state in the air cooling operation and is in a B state in the air heating operation.

The outdoor heat exchanger 140 is disposed in an outdoor space, and the refrigerant passing through the outdoor heat exchanger 140 is thermally exchanged with outdoor air in the outdoor heat exchanger 140. The outdoor heat exchanger 140 functions as a condenser in an air cooling operation and functions as an evaporator in an air heating operation.

The outdoor heat exchanger 140 is coupled to a first inflow pipe 166 and then coupled to the indoor unit IU through a liquid pipe 165. The outdoor heat exchanger 140 is coupled to a second inflow pipe 167 and then coupled to the 4-way valve 160.

The supercooler 180 includes a supercooling heat exchanger 184, a second bypass pipe 181, a supercooling expansion valve 182, and a discharge pipe 185. The supercooling heat exchanger 184 is disposed on the first inflow pipe 166. In an air cooling operation, the second bypass pipe 181 functions to bypass the refrigerant discharged from the supercooling heat exchanger 184 so that the discharged refrigerant flows in the supercooling expansion valve 182.

The supercooling expansion valve 182 is disposed on the second bypass pipe 181. The supercooling expansion valve 182 lowers the pressure and temperature of a refrigerant by constricting the refrigerant of a liquid state that flows in the second bypass pipe 181 and then forces the refrigerant to flow in the supercooling heat exchanger 184. The supercooling expansion valve 182 may have various types, and a linear expansion valve may be used as the supercooling expansion valve 182 for convenience of use. A supercooling temperature sensor 183 for detecting temperature of the refrigerant constricted by the supercooling expansion valve 182 is installed on the second bypass pipe 181.

In an air cooling operation, a condensed refrigerant passing through the outdoor heat exchanger 140 is super-cooled through a thermal exchange with a refrigerant of low temperature, introduced through the second bypass pipe 181, in the supercooling heat exchanger 184, and the super-cooled refrigerant flows in the indoor unit IU.

The refrigerant passing through the second bypass pipe 181 is thermally exchanged in the supercooling heat exchanger 184, and the thermally exchanged refrigerant flows in the accumulator 187 through the discharge pipe 185. A discharge pipe temperature sensor 178 for detecting temperature of the refrigerant entering the accumulator 187 is installed on the discharge pipe 185.

A liquid pipe temperature sensor 174 and a liquid pipe pressure sensor 156 are installed on the liquid pipe 165 which couples the supercooler 180 and the indoor unit IU.

In the air conditioner according to the embodiment of the present invention, the indoor unit IU includes the indoor heat exchanger 120, an indoor fan 125, and an indoor expansion valve 131. The air conditioner may include one or a plurality of the indoor units IU.

The indoor heat exchanger 120 is disposed in an indoor space, and a refrigerant passing through the indoor heat exchanger 120 is thermally exchanged with indoor air in the indoor heat exchanger 120. The indoor heat exchanger 120 functions as an evaporator in an air cooling operation and functions as a condenser in an air heating operation. An indoor temperature sensor 176 for detecting indoor temperature is installed in the indoor heat exchanger 120.

The indoor expansion valve 131 is an apparatus for constricting an inflow refrigerant in an air cooling operation. The indoor expansion valve 131 is installed in the indoor inlet pipe 163 of the indoor unit IU. The indoor expansion valve 131 may have various types, and a linear expansion valve may be used as the indoor expansion valve 131, for convenience of use. It is preferred that the indoor expansion valve 131 be opened in a set opening degree in an air cooling operation and be fully opened in an air heating operation.

An indoor inlet pipe temperature sensor 173 is installed on the indoor inlet pipe 163. The indoor inlet pipe temperature sensor 173 may be installed between the indoor heat exchanger 120 and the indoor expansion valve 131. Furthermore, an indoor outlet pipe temperature sensor 172 is installed on the indoor outlet pipe 164.

In the air cooling operation of the above-described air conditioner, the flow of a refrigerant is described below.

A refrigerant of a high temperature and high pressure and a gaseous state, discharged from the compressor 110, flows in the outdoor heat exchanger 140 through the 4-way valve 160 and the second inflow pipe 167. The refrigerant is thermally exchanged with outdoor air in the outdoor heat exchanger 140 and thus condensed. The refrigerant drained from the outdoor heat exchanger 140 flows in the supercooler 180 through the first inflow pipe 166. Next, the refrigerant is super-cooled by the supercooling heat exchanger 184, and the super-cooled refrigerant flows in the indoor unit IU.

A part of the refrigerant super-cooled by the supercooling heat exchanger 184 is constricted by the supercooling expansion valve 182, so that the refrigerant passing through the supercooling heat exchanger 184 is super-cooled. The refrigerant super-cooled by the supercooling heat exchanger 184 flows in the accumulator 187.

The refrigerant flowed in the indoor unit IU is constricted by the indoor expansion valve 131 opened in a set opening degree and is then thermally exchanged with indoor air in the indoor heat exchanger 120, thus being evaporated. The evaporated refrigerant flows in the compressor 110 through the 4-way valve 160 and the accumulator 187.

In the air heating operation of the above-described air conditioner, the flow of a refrigerant is described below.

A refrigerant of a high temperature and high pressure and a gaseous state, discharged from the compressor 110, flows in the indoor unit IU through the 4-way valve 160. Here, the indoor expansion valves 131 of the indoor units IU are fully opened. The refrigerant drained from the indoor unit IU flows in the outdoor heat exchanger 140 through the first inflow pipe 166. Next, the refrigerant is thermally exchanged with outdoor air in the outdoor heat exchanger 140, thus being evaporated. The evaporated refrigerant flows in the suction pipe 162 of the compressor 110 through the 4-way valve 160 and the accumulator 187 through the second inflow pipe 167.

In an air heating operation, if outdoor temperature is very low, frost may be generated in the outdoor heat exchanger 140. In this case, a defrosting operation for removing the frost generated in the outdoor heat exchanger 140 may be performed. In this case, the flow of a refrigerant is the same as that in the air cooling operation. A defrosting operation for removing frost in the entire outdoor heat exchanger 140 according to the flow of a refrigerant identical with that in the air cooling operation is called a full defrosting operation, which is different from a partial defrosting operation to be described later.

Figure 2:
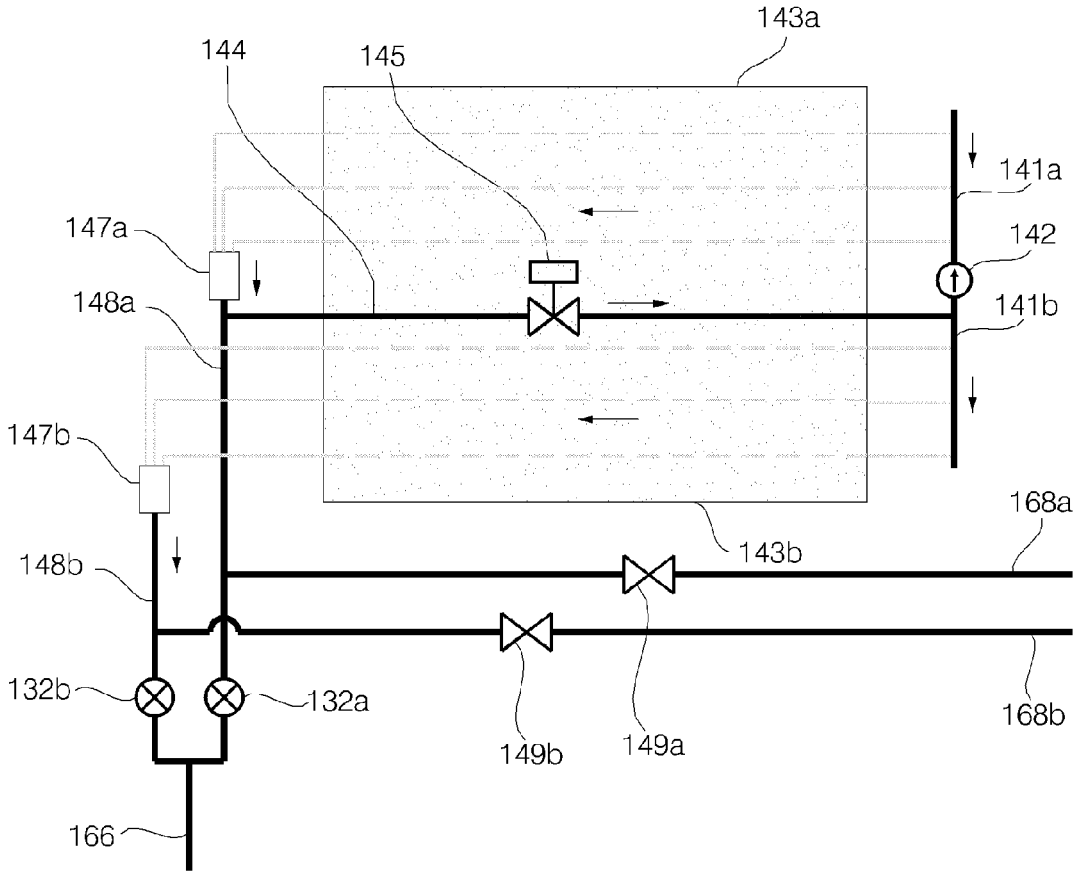
FIGS. 2 and 3 show the constructions of outdoor heat exchangers according to embodiments of the present invention.
Figure 3:
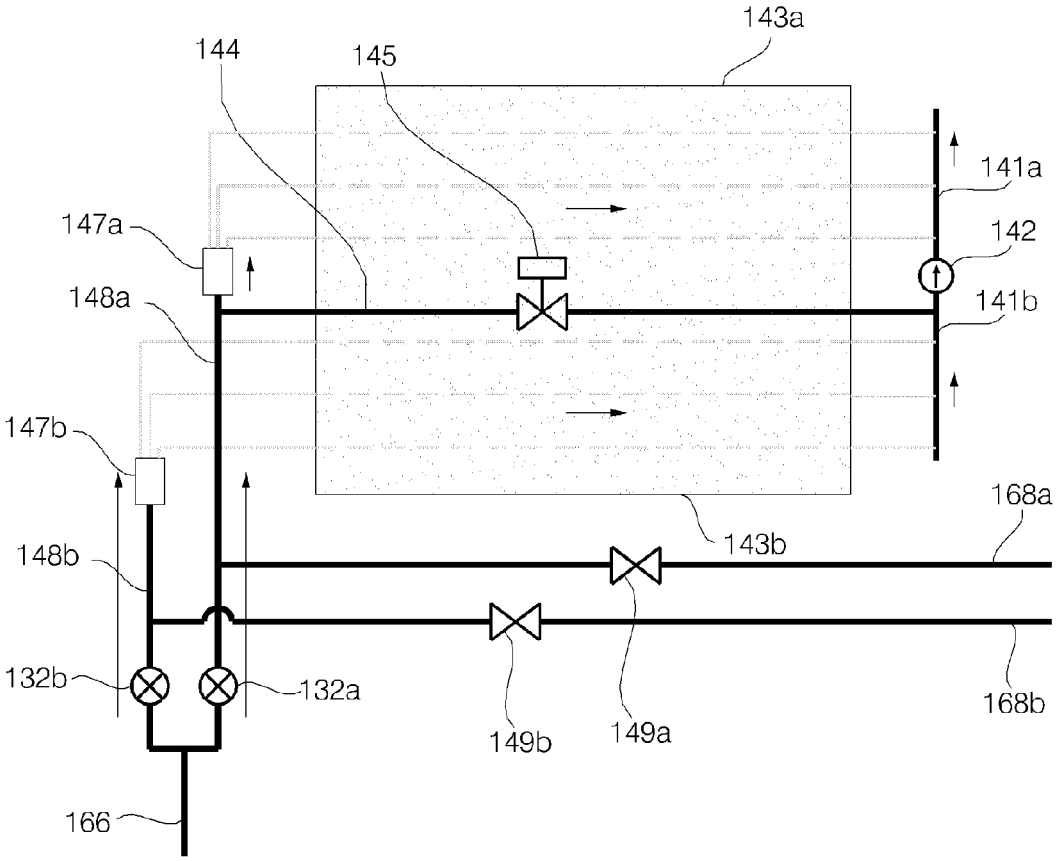

FIGS. 2 and 3 show the constructions of outdoor heat exchangers according to embodiments of the present invention.

The outdoor heat exchanger 140 according to an embodiment of the present invention includes a first header pipe 141*a* configured to have a refrigerant, compressed by the compressor in an air cooling operation, flowed therein, a first heat exchange unit 143*a* coupled to the first header pipe 141*a* and configured to thermally exchange a refrigerant with air, a bypass pipe 144 configured to have a refrigerant, thermally exchanged in the first heat exchange unit in an air cooling operation, to flow therein, a first distribution pipe 148*a* coupled to the bypass pipe 144, a second header pipe 141*b* configured to have a refrigerant, passing through the bypass pipe 144 in an air cooling operation, to flow therein, a second heat exchange unit 143*b* coupled to a second header pipe 141*b* and configured to thermally exchange a refrigerant with air, a second distribution pipe 148*b* configured to have a refrigerant, thermally exchanged in the second heat exchange unit 143*b* in an air cooling operation, to flow therein, a second hot gas pipe 168*b* configured to couple the compressor 110 and the second distribution pipe 148*b*, and a second hot gas control valve 149*b* disposed in the second hot gas pipe 168*b* to control the flow of a refrigerant.

The first header pipe 141*a* has one end coupled to the second inflow pipe 167 and thus coupled to the compressor 110. The first header pipe 141*a* has the other end coupled to the bypass pipe 144 and the second header pipe 141*b*. A check valve 142 is disposed at the other end of the first header pipe 141*a*. The check valve 142 controls the flow direction of a refrigerant so that the refrigerant from the first header pipe 141*a* is prevented from entering the second header pipe 141*b* and the refrigerant flows from the second header pipe 141*b* to the first header pipe 141*a*.

The first header pipe 141*a* is coupled to one end of the first heat exchange unit 143*a*. The first header pipe 141*a* is coupled to the plurality of refrigerant tubes of the first heat exchange unit 143*a*. That is, the first header pipe 141*a* is branched into the plurality of refrigerant tubes of the first heat exchange unit 143*a*.

The first heat exchange unit 143*a* has one end coupled to the first header pipe 141*a* and has the other end coupled to a first distributor 147*a*. The first heat exchange unit 143*a* includes a plurality of refrigerant tubes and a plurality of electric heat pins in which a refrigerant flows and thus thermally exchanges the refrigerant with air. One ends of the plurality of refrigerant tubes of the first heat exchange unit 143*a* are merged into the first header pipe 141*a*, and the other ends thereof are merged into the first distributor 147*a*.

The first distributor 147*a* couples the other end of the first heat exchange unit 143*a* and the first distribution pipe 148*a*. The plurality of refrigerant tubes of the first heat exchange unit 143*a* is merged and coupled to the first distributor 147*a*.

The first distribution pipe 148*a* is coupled to the first distributor 147*a*. The first distribution pipe 148*a* is coupled to the other end of the first heat exchange unit 143*a* through the first distributor 147*a*. The first distribution pipe 148*a* is coupled to the first inflow pipe 166. The first distribution pipe 148*a* and the second distribution pipe 148*b* are merged into the first inflow pipe 166.

A first expansion valve 132*a* for controlling the degree of opening of the first distribution pipe 148*a* is disposed in the first distribution pipe 148*a*. The first expansion valve 132*a* may constrict, bypass, or block a refrigerant passing through the first distribution pipe 148*a*. In an air cooling operation, the first expansion valve 132*a* is closed. In an air heating operation and a partial defrosting operation, the degree of opening of the first expansion valve 132*a* is controlled, and thus the first expansion valve 132*a* constricts a refrigerant.

A first hot gas pipe 168*a* may be coupled to the first distribution pipe 148*a*. The first hot gas pipe 168*a* is branched from the hot gas pipe 168, thus coupling the compressor 110 and the first distribution pipe 148*a*. In accordance with an embodiment, the first distribution pipe 148*a* may be coupled to the first distributor 147*a* or may be coupled to the other end of the first heat exchange unit 143*a*.

The first hot gas pipe 168*a* may be equipped with a first hot gas control valve 149*a* opened to control the flow of a refrigerant. The first hot gas control valve 149*a* is closed in an air cooling operation and an air heating operation. The first hot gas control valve 149*a* may be opened in a special defrosting operation in order to remove frost generated in the first heat exchange unit 143*a*, according to an embodiment.

The bypass pipe 144 has one end coupled to the first distribution pipe 148*a* and has the other end coupled to the second header pipe 141*b*. A bypass valve 145 for controlling the flow of a refrigerant is disposed in the bypass pipe 144. In an air cooling operation, the bypass valve 145 may be opened so that a refrigerant flows from the first distributor 147*a* to the second header pipe 141*b*. In an air heating operation and a partial defrosting operation, the bypass valve 145 may be closed so that a refrigerant is prevented from flowing from the second header pipe 141*b* to the first distributor 147*a*.

In accordance with an embodiment, the bypass pipe 144 may be coupled to the first distributor 147*a* or may be coupled to the other end of the first heat exchange unit 143*a*.

The second header pipe 141*b* is coupled to the bypass pipe 144 and the first header pipe 141*a*. The second header pipe 141*b* is coupled to one end of the second eat exchange unit 143*b*. The second header pipe 141*b* is coupled to a plurality of refrigerant tubes of the second heat exchange unit 143*b*. That is, the second header pipe 141*b* is branched into the plurality of refrigerant tubes of the second heat exchange unit 143*b*.

The second heat exchange unit 143*b* has one end coupled to the second header pipe 141*b* and has the other end coupled to the second distributor 147*b*. The second heat exchange unit 143*b* includes the plurality of refrigerant tubes and the plurality of electric heat pins in which a refrigerant flows and thermally exchanges the refrigerant with air. One ends of the plurality of refrigerant tubes of the second heat exchange unit 143*b* are merged into the second header pipe 141*b*, and the other ends thereof are merged into the second distributor 147*b*.

The second heat exchange unit 143*b* is disposed beneath the first heat exchange unit 143*a*. That is, the first heat exchange unit 143*a* and the second heat exchange unit 143*b* may be vertically disposed, and they may share the plurality of electric heat pins.

The second distributor 147*b* couples the other end of the second heat exchange unit 143*b* and the second distribution pipe 148*b*. The plurality of refrigerant tubes of the second heat exchange unit 143*b* is merged and coupled to the second distributor 147*b*.

The second distribution pipe 148*b* is coupled to a second distributor 147*b*. The second distribution pipe 148*b* is coupled to the other end of the second heat exchange unit 143*b* through the second distributor 147*b*. The second distribution pipe 148*b* is merged with the first distribution pipe 148*a* and then coupled to the first inflow pipe 166.

A second expansion valve 132*b* for controlling the degree of opening of the second distribution pipe 148*b* is disposed in the second distribution pipe 148*b*. The second expansion valve 132*b* may constrict, bypass, or block a refrigerant passing through the second distribution pipe 148*b*. In an air cooling operation, the second expansion valve 132*b* is opened. In an air heating operation, the degree of opening of the second expansion valve 132*b* is controlled so that a refrigerant is constricted. In the partial defrosting operation, the second expansion valve 132*b* is closed.

The second hot gas pipe 168*b* may be coupled to the second distribution pipe 148*b*. The second hot gas pipe 168*b* is branched from the hot gas pipe 168, thus coupling the compressor 110 and the second distribution pipe 148*b*. In accordance with an embodiment, the second distribution pipe 148*b* may be coupled to the second distributor 147*b* or may be coupled to the other end of the second heat exchange unit 143*b*.

The second hot gas pipe 168*b* may be equipped with the second hot gas control valve 149*b* opened to control the flow of a refrigerant. The second hot gas control valve 149*b* is closed in an air cooling operation and an air heating operation. The second hot gas control valve 149*b* is opened in the partial defrosting operation so that a refrigerant compressed by the compressor 110 flows in the second heat exchange unit 143*b*.

In the air cooling operation of the above-described outdoor heat exchanger, the flow of a refrigerant is described below with reference to FIG. 2.

A refrigerant compressed by the compressor 110 flows in the first header pipe 141*a* through the second inflow pipe 167. The check valve 142 prevents the refrigerant flowed in the first header pipe 141*a* from flowing into the second header pipe 141*b*. The refrigerant flowed in the first header pipe 141*a* flows in the first heat exchange unit 143*a*.

The refrigerant flowed in the first heat exchange unit 143*a* is condensed through a thermal exchanged with air. The refrigerant condensed by the first heat exchange unit 143*a* flows in the first distribution pipe 148*a* through the first distributor 147*a*. In an air cooling operation, the first expansion valve 132*a* is closed. Thus, the refrigerant flowed in the first distribution pipe 148*a* does not flow in the first inflow pipe 166, but flows in the bypass pipe 144.

In an air cooling operation, the bypass valve 145 is opened so that the refrigerant passing through the bypass pipe 144 flows in the second header pipe 141*b*. The refrigerant flowed in the second header pipe 141*b* flows in the second heat exchange unit 143*b*.

The refrigerant flowed in the second heat exchange unit 143*b* is condensed again through a thermal exchanged with air. The refrigerant condensed by the second heat exchange unit 143*b* flows in the second distribution pipe 148*b* through the second distributor 147*b*. In an air cooling operation, the second expansion valve 132*b* is fully opened. Thus, the refrigerant flowed in the first inflow pipe 166 flows in the indoor unit IU through the liquid pipe 165.

In the air heating operation of the above-described outdoor heat exchanger, the flow of a refrigerant is described below with reference to FIG. 3.

A refrigerant condensed by the indoor heat exchanger 120 of the indoor unit IU flows in the first inflow pipe 166 through the liquid pipe 165. The refrigerant flowed in the first inflow pipe 166 flows in the first distribution pipe 148*a* and the second distribution pipe 148*b*.

The refrigerant flowed in the second distribution pipe 148*b* is expanded by the second expansion valve 132*b* having an opening degree controlled. The refrigerant expanded by the second expansion valve 132*b* flows in the second heat exchange unit 143*b* through the second distributor 147*b*. The refrigerant flowed in the second heat exchange unit 143*b* is evaporated through a thermal exchange with air. The refrigerant evaporated by the second heat exchange unit 143*b* flows in the second header pipe 141*b*.

In an air heating operation, the bypass valve 145 is closed so that the refrigerant flowed in the second header pipe 141*b* does not pass through the bypass pipe 144. The refrigerant flowed in the second header pipe 141*b* flows in the first header pipe 141*a* through the check valve 142.

Meanwhile, the refrigerant flowed in the first distribution pipe 148*a* is expanded by the first expansion valve 132*a*. In an air heating operation, the bypass valve 145 is closed. Thus, the refrigerant expanded by the first expansion valve 132*a* does not flow in the second header pipe 141*b*, but flows in the first heat exchange unit 143*a* through the first distributor 147*a*.

The refrigerant flowed in the first heat exchange unit 143*a* is evaporated through a thermal exchange with air.

The refrigerant evaporated by the first heat exchange unit 143*a* flows in the first header pipe 141*a*. The refrigerant flowed in the first header pipe 141*a* is merged with the refrigerant passing through the second header pipe 141*b*. Next, the merged refrigerant flows in the second inflow pipe 167 and then flows in the compressor 110.

The flow of a refrigerant of the outdoor heat exchanger in the above-described cooling operation is the same as the flow of a refrigerant in the full defrosting operation.

Figure 4:
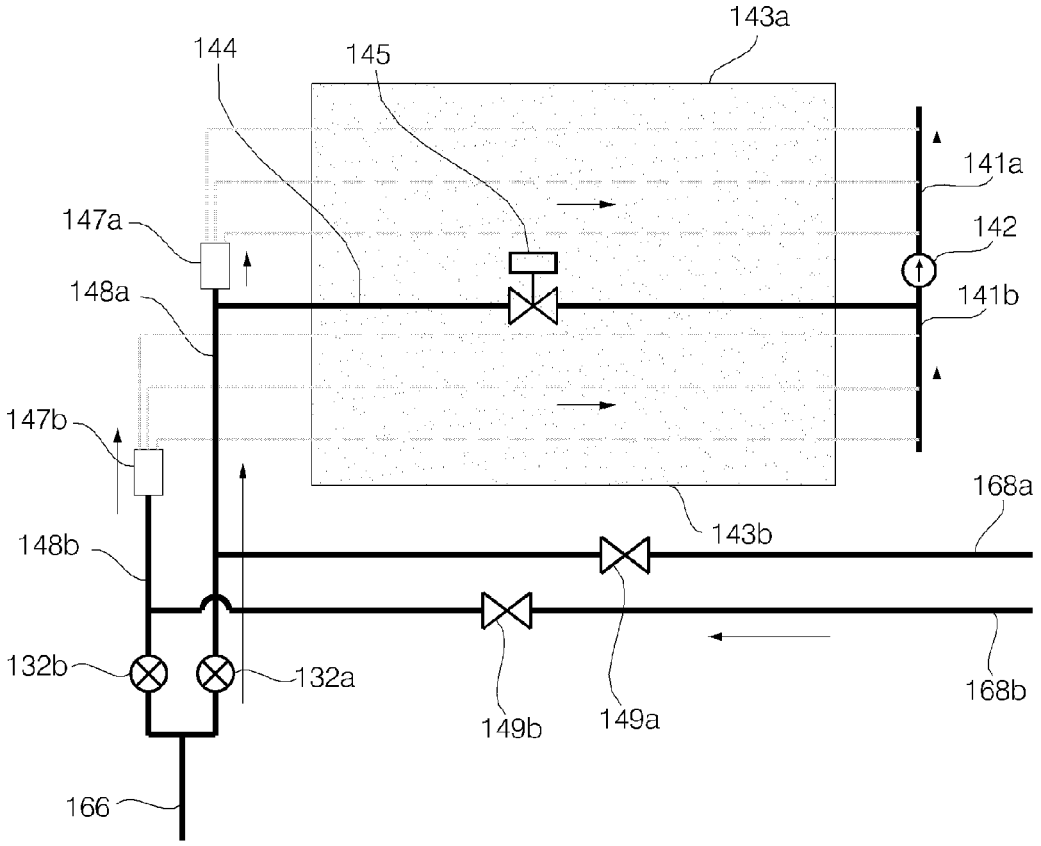
FIG. 4 is a diagram showing the flow of a refrigerant in the partial defrosting operation of the outdoor heat exchanger according to an embodiment of the present invention.

FIG. 4 is a diagram showing the flow of a refrigerant in the partial defrosting operation of the outdoor heat exchanger according to an embodiment of the present invention.

The partial defrosting operation basically includes an air heating operation and includes defrosting a part of the heat exchange unit. In the present embodiment, the partial defrosting operation is performed to defrost the second heat exchange unit 143*b*. That is, the first heat exchange unit 143*a* functions as an evaporator for performing the air heating operation, but gas of a high temperature and high pressure, compressed by the compressor 110, flows in the second heat exchange unit so that frost is removed.

In the full defrosting operation, the second heat exchange unit 143*b* has low defrosting performance because a refrigerant thermally exchanged with outdoor air in the first heat exchange unit 143*a* flows in the second heat exchange unit 143*b*. Accordingly, it is preferred that the partial defrosting operation be performed for a predetermined time prior to the full defrosting operation.

In the partial defrosting operation, the flow of a refrigerant is described below with reference to FIG. 4.

A refrigerant condensed by the indoor heat exchanger 120 of the indoor unit IU flows in the first inflow pipe 166 through the liquid pipe 165. In the partial defrosting operation, the second expansion valve 132*b* is closed. Thus, the refrigerant flowed in the first inflow pipe 166 fully flows in the first distribution pipe 148*a*.

The refrigerant flowed in the first distribution pipe 148*a* is expanded by the first expansion valve 132*a*. The bypass valve 145 is closed in the partial defrosting operation. Thus, the refrigerant expanded by the first expansion valve 132*a* does not flow in the second header pipe 141*b*, but flows in the first heat exchange unit 143*a* through the first distributor 147*a*. The refrigerant flowed in the first heat exchange unit 143*a* is evaporated through a thermal exchange with air.

The refrigerant evaporated by the first heat exchange unit 143*a* flows in the first header pipe 141*a*. The refrigerant flowed in the first header pipe 141*a* flows in the second inflow pipe 167 and then flows in the compressor 110.

Meanwhile, in the partial defrosting operation, the second hot gas control valve 149*b* is opened, and thus a part of the refrigerant compressed by the compressor 110 and then discharged toward the discharge pipe 161 flows in the second hot gas pipe 168*b*. The refrigerant flowed in the second hot gas pipe 168*b* flows in the second distribution pipe 148*b* and then flows in the second heat exchange unit 143*b* through the second distributor 147*b*.

The refrigerant flowed in the second heat exchange unit 143*b* flows through the second heat exchange unit 143*b* and heats the second heat exchange unit 143*b*, thus removing frost. After flowing through the second heat exchange unit 143*b*, the refrigerant flows in the second header pipe 141*b*.

In the partial defrosting operation, the bypass valve 145 is closed, and thus the refrigerant flowed in the second header pipe 141*b* does not pass through the bypass pipe 144. The refrigerant flowed in the second header pipe 141*b* flows in the first header pipe 141*a* through the check valve 142.

After the partial defrosting operation is performed, the full defrosting operation having the same flow of a refrigerant as the above-described cooling operation may be performed.

The outdoor heat exchanger of the present invention has one or more of the following advantages.

First, there is an advantage in that the passage of a refrigerant is varied in an air cooling operation and an air heating operation.

Second, there is an advantage in that only part of the heat exchange unit may be defrosted in an air heating operation.

Third, there is an advantage in that the defrosting operation can be efficiently performed.

Effects of the present invention are not limited to the above-mentioned effects, and other effects that have not been described above will be evident to those skilled in the art from the following description.

Furthermore, although the preferred embodiments of the present invention have been illustrated and described, the present invention is not limited to the above specific embodiments, and a person having ordinary skill in the art to which the invention belongs may modify the embodiments in various ways without departing from the gist of the present invention which is claimed in the claims. The modified embodiments should not be interpreted individually from the technical spirit or prospect of the present invention.

What is claimed is:

1. An outdoor heat exchanger included in an air conditioner and configured to function as a condenser in an air cooling operation and as an evaporator in an air heating operation, the outdoor heat exchanger comprising:

a first header pipe configured to have a refrigerant compressed by a compressor to flow therein in the air cooling operation;

a first heat exchange unit coupled to the first header pipe to receive the refrigerant from the first header pipe and configured to thermally exchange the refrigerant with air;

a bypass pipe configured to have the refrigerant thermally exchanged in the first heat exchange unit to flow therein in the air cooling operation;

a first distribution pipe coupled to the bypass pipe;

a second header pipe configured to have the refrigerant passing through the bypass pipe to flow therein in the air cooling operation;

a second heat exchange unit coupled to the second header pipe to receive the refrigerant from the second header pipe and configured to thermally exchange the refrigerant with air;

a second distribution pipe configured to have the refrigerant thermally exchanged in the second heat exchange unit to flow therein in the air cooling operation;

a first hot gas pipe configured to couple the compressor and the first distribution pipe;

a first hot gas control valve disposed in the first hot gas pipe to control a flow of the refrigerant;

a second hot gas pipe configured to couple the compressor and the second distribution pipe;

a second hot gas control valve disposed in the second hot gas pipe to control a flow of the refrigerant;

a bypass valve disposed in the bypass pipe configured to open or close to control the flow of the refrigerant; and a first junction point, wherein a downstream end of the first header pipe is coupled to an upstream end of the second header pipe, wherein an upstream end of the first header pipe is connected to the compressor, wherein the first junction point connects a downstream end of the bypass pipe, the downstream end of the first header pipe, and the upstream end of the second header pipe, and further comprising a check valve disposed in the first header pipe to prevent the refrigerant from flowing from the first header pipe to the second header pipe in the air cooling operation;

a first expansion valve disposed in the first distribution pipe and configured to control a degree of opening of the first distribution pipe; and a second expansion valve disposed in the second distribution pipe and configured to control a degree of opening of the second distribution pipe.

2. The outdoor heat exchanger of claim 1, wherein the second heat exchange unit is disposed beneath the first heat exchange unit.

3. The outdoor heat exchanger of claim 1, wherein the bypass valve is opened in the air cooling operation.

4. The outdoor heat exchanger of claim 3, wherein:

the second hot gas control valve is opened in a partial defrosting operation, the bypass valve is closed in the partial defrosting operation, and the refrigerant compressed by the compressor flows in the second heat exchange unit in the partial defrosting operation.

5. The outdoor heat exchanger of claim 4, wherein the first expansion valve is closed in the air cooling operation, the second expansion valve is opened in the air cooling operation, and the second expansion valve is closed in the partial defrosting operation.

6. An air conditioner comprising:

a compressor;

an indoor heat exchanger;

an outdoor heat exchanger; and a 4-way valve guiding a refrigerant compressed by the compressor to the outdoor heat exchanger in an air cooling operation and in a defrosting operation, and guiding the compressed refrigerant to the indoor heat exchanger in an air heating operation, wherein the outdoor heat exchanger comprises, a first header pipe coupled to the compressor, a first heat exchange unit comprising a first end coupled to the first header pipe and configured to thermally exchange the refrigerant with air, a first distribution pipe coupled to a second end of the first heat exchange unit, a bypass pipe coupled to the first distribution pipe, a second header pipe coupled to the first header pipe and the bypass pipe, a second heat exchange unit comprising a first end coupled to the second header pipe and configured to thermally exchange the refrigerant with air, a second distribution pipe coupled to a second end of the second heat exchange unit, a first hot gas pipe configured to couple the compressor and the first distribution pipe;

a first hot gas control valve disposed in the first hot gas pipe to control a flow of the refrigerant;

a second hot gas pipe configured to couple the compressor and the second distribution pipe, a second hot gas control valve disposed in the second hot gas pipe and configured to open or close to control a flow of the refrigerant, a bypass valve disposed in the bypass pipe and configured to open or close to control the flow of the refrigerant, and a first junction point, wherein an upstream end of the first header pipe is connected to the compressor, wherein the first junction point, connects a downstream end of the bypass pipe, a downstream end of the first header pipe, and a downstream end of the second header pipe, and further comprising a check valve disposed in the first header pipe to prevent the refrigerant from flowing from the first header pipe to the second header pipe in the air cooling operation;

a first expansion valve disposed in the first distribution pipe and configured to control a degree of opening of the first distribution pipe; and a second expansion valve disposed in the second distribution pipe and configured to control a degree of opening of the second distribution pipe.

7. The air conditioner of claim 6, wherein the bypass valve is opened in the air cooling operation.

8. The air conditioner of claim 7, wherein:

the second hot gas control valve is opened in the defrosting operation, the bypass valve is closed in the defrosting operation, and the refrigerant compressed by the compressor flows in the second heat exchange unit in the defrosting operation.

9. The outdoor heat exchanger of claim 4, wherein the first hot gas control valve is closed in the air cooling operation and the air heating operation, and the first gas control valve is opened in a special defrosting operation.

10. The outdoor heat exchanger of claim 1, further comprising:

a first distributor coupled to the first distribution pipe; and a second junction point that connects an upstream end of the first distribution pipe, a downstream end of the first distributor, and an upstream end of the bypass pipe.

11. The air conditioner of claim 6, further comprising:

a first distributor coupled to the first distribution pipe; and a second junction point that connects an upstream end of the first distribution pipe, a downstream end of the first distributor, and an upstream end of the bypass pipe.

* * * * *